US007733284B2

(12) United States Patent
Babitsky et al.

(10) Patent No.: US 7,733,284 B2
(45) Date of Patent: Jun. 8, 2010

(54) BROADBAND LAND MOBILE ANTENNA

(75) Inventors: Gennady Babitsky, Nesher (IL); Matti Martiskainen, Tiberias Illit (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 10/573,347

(22) PCT Filed: Mar. 13, 2006

(86) PCT No.: PCT/IL2006/000324

§ 371 (c)(1),
(2), (4) Date: Sep. 8, 2008

(87) PCT Pub. No.: WO2006/097919

PCT Pub. Date: Sep. 21, 2006

(65) Prior Publication Data

US 2009/0021449 A1 Jan. 22, 2009

Related U.S. Application Data

(60) Provisional application No. 60/661,795, filed on Mar. 14, 2005.

(51) Int. Cl.
*H01Q 1/36* (2006.01)
*H01Q 9/04* (2006.01)

(52) U.S. Cl. ..... 343/791; 343/895

(58) Field of Classification Search ..... 343/790–793, 343/895
See application file for complete search history.

(56) References Cited

U.S. PATENT DOCUMENTS

| | | | | | |
|---|---|---|---|---|---|
| 3,852,759 | A * | 12/1974 | Felsenheld et al. | ..... | 343/729 |
| 4,772,895 | A | 9/1988 | Garay et al. | ..... | 343/702 |
| 4,800,395 | A * | 1/1989 | Balzano et al. | ..... | 343/895 |
| 4,914,450 | A * | 4/1990 | Dilley et al. | ..... | 343/895 |
| 5,892,480 | A * | 4/1999 | Killen | ..... | 343/895 |
| 5,909,196 | A | 6/1999 | O'Neill, Jr. | ..... | 343/895 |
| 6,054,966 | A * | 4/2000 | Haapala | ..... | 343/895 |
| 6,172,655 | B1 * | 1/2001 | Volman | ..... | 343/895 |
| 6,525,692 | B2 * | 2/2003 | Kim et al. | ..... | 343/702 |

* cited by examiner

*Primary Examiner*—Michael C Wimer
(74) *Attorney, Agent, or Firm*—Abelman, Frayne & Scwab

(57) ABSTRACT

There is provided a monopole antenna including a helical radiating element including a first longitudinal portion having a first winding pitch and a second longitudinal portion having a second winding pitch and a cylindrical radiating element generally coaxial with the helical radiating element and extending along at least most of the first longitudinal portion.

3 Claims, 7 Drawing Sheets

BROADBAND LAND MOBILE ANTENNA

REFERENCE TO RELATED APPLICATIONS

The present application is related to U.S. Provisional Patent Application Ser. No. 60/661,795 filed Mar. 14, 2005, and entitled BROADBAND LAND MOBILE ANTENNA, the disclosure of which is hereby incorporated by reference and priority of which is hereby claimed pursuant to 37 CFR 1.78(a) (4) and (5)(i).

FIELD OF THE INVENTION

The present invention relates to antennas generally and more particularly to broadband antennas for mobile devices.

BACKGROUND OF TE INVENTION

The following Patent documents are believed to represent the current state of the art:

U.S. Pat. No. 4,772,895.

SUMMARY OF THE INVENTION

The present invention seeks to provide an improved antenna for mobile devices.

There is thus provided in accordance with a preferred embodiment of the present invention a monopole antenna including a helical radiating element including a first longitudinal portion having a first winding pitch and a second longitudinal portion having a second winding pitch and a cylindrical radiating element generally coaxial with the helical radiating element and extending along at least most of the first longitudinal portion.

In accordance with a preferred embodiment of the present invention the monopole antenna also includes a dielectric separator located between the helical radiating element and the cylindrical radiating element. Preferably, the monopole antenna also includes a dielectric insert located interior of the helical radiating element and being configured to maintain the first winding pitch of the first longitudinal portion of the helical radiating element.

In accordance with another preferred embodiment of the present invention the second winding pitch is greater than the first winding pitch. Preferably, the second winding pitch is 40-50% greater than the first winding pitch.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
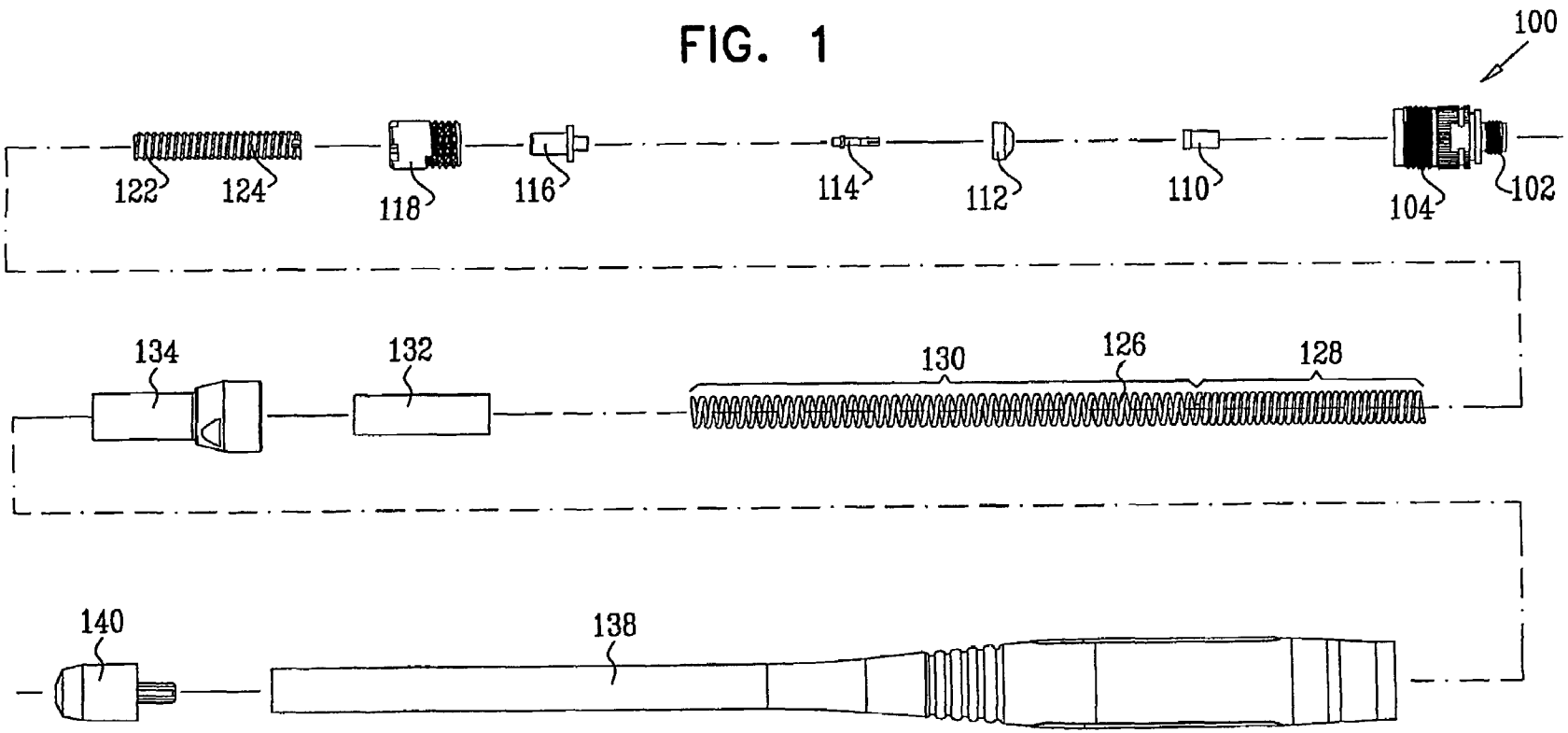
FIG. 1 is a simplified exploded view illustration of an antenna constructed and operative in accordance with a preferred embodiment of the present invention.
Figure 2A:
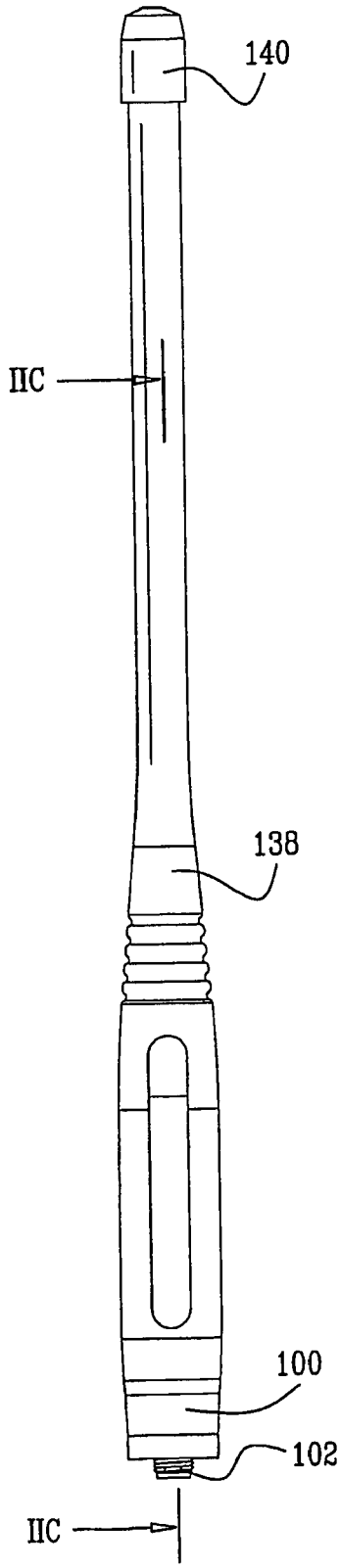
FIGS. 2A, 2B and 2C are, respectively, a simplified assembled pictorial illustration, a partially cut away pictorial illustration and a sectional illustration of the antenna of FIG. 1, the sectional illustration being taken along section lines IIC-IIC in FIG. 2A.
Figure 2B:
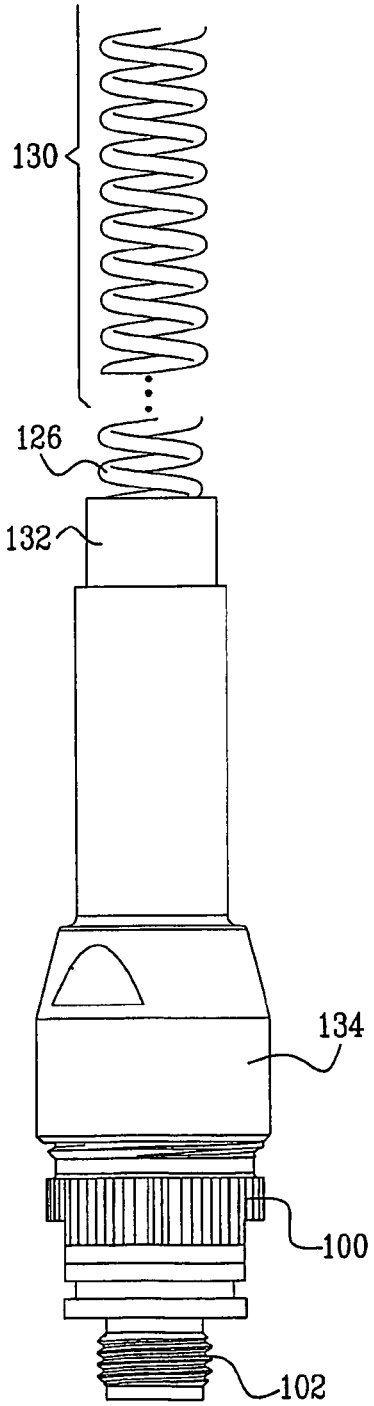
Figure 2C:
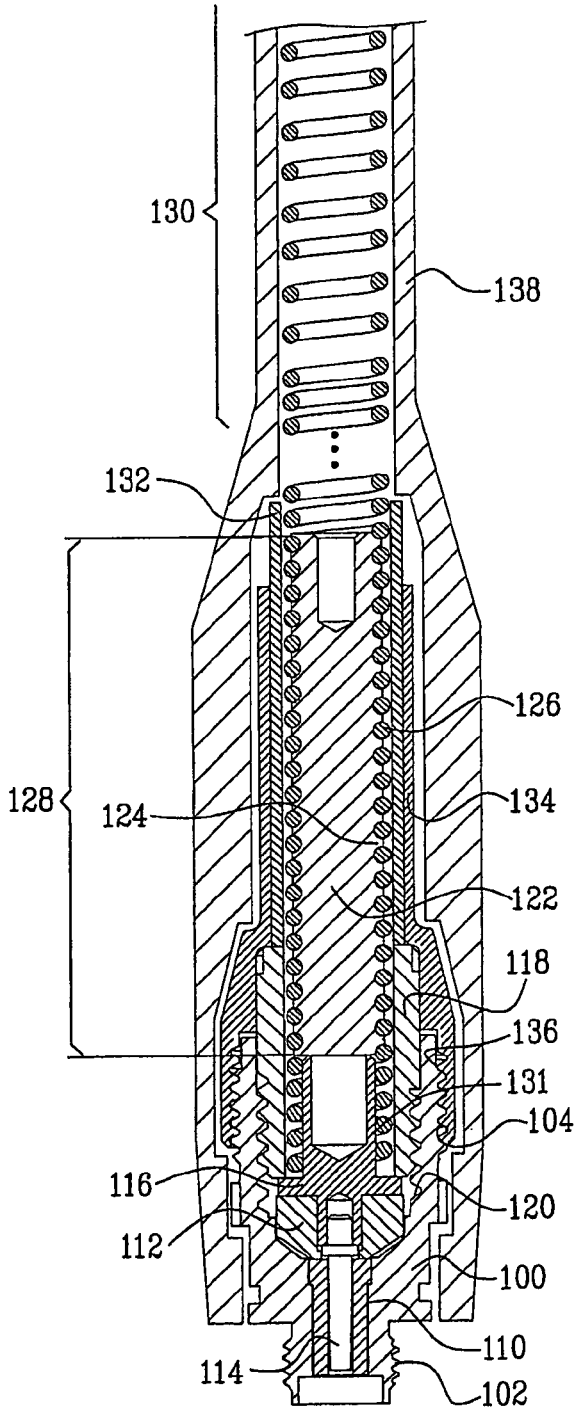

Reference is now made to FIG. 1, which is a simplified exploded view illustration of an antenna constructed and operative in accordance with a preferred embodiment of the present invention and to FIGS. 2A, 2B and 2C, which are, respectively, a simplified assembled pictorial illustration, a partially cut away pictorial illustration and a sectional illustration of the antenna of FIG. 1.

As seen in FIGS. 1 and 2A-2C, the antenna comprises a conductive base 100 having a relatively narrow externally threaded portion 102 which is adapted to threadably engage an antenna base socket in a communicator, such as a mobile telephone. Base 100 also includes a relatively wide externally threaded portion 104.

An insulative pin socket element 110 and an insulative pin socket collar 112 are disposed interiorly of base 100. A conductive pin 114 is also disposed within base 100, interiorly of pin socket element 110 and pin socket collar 112. A conductive coil base element 116 is seated in pin socket collar 112 and surrounds a head portion of pin 114. An insulative externally threaded locking element 118 threadably engages internal threading 120 formed on base 100.

Figure 3A:
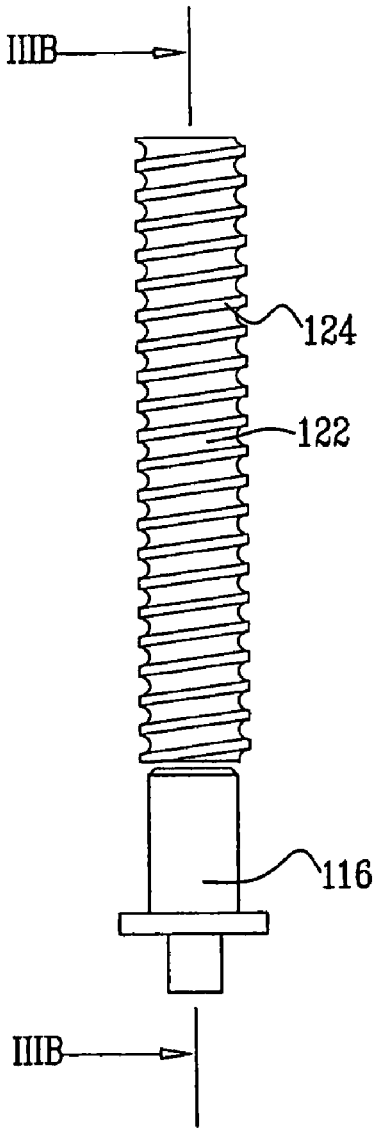
FIGS. 3A and 3B are a simplified assembled pictorial illustration and a sectional illustration of a coil base internal support and a coil base element, forming part of the antenna assembly of FIGS. 1-2C, the sectional illustration being taken along section lines IIIB-IIIB in FIG. 3A.
Figure 3B:
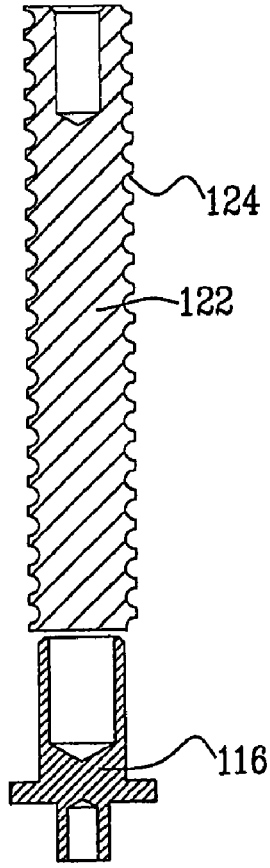

In accordance with a preferred embodiment of the present invention, a dielectric insert, such as an insulative coil base internal support 122, is formed with a coil pitch determining template 124 on an outer generally cylindrical surface thereof, which defines a first coil pitch, preferably in the range of 7-8 turns per cm. Engagement of a helical radiating element, such as a conductive antenna coil 126, with dielectric coil base internal support 122 ensures that a first longitudinal portion, designated by reference numeral 128, of the antenna coil 126 in engagement with template 124 has the first coil pitch. Preferably, a second longitudinal portion, designated by reference numeral 130, of antenna coil 126, which does not engage template 124, has a second coil pitch, typically 40-50% greater than the first coil pitch, preferably in the range of 4-6 turns per cm. The coil base element 116 and the coil base internal support 122 are shown in detail in FIGS. 3A and 3B.

Figure 4A:
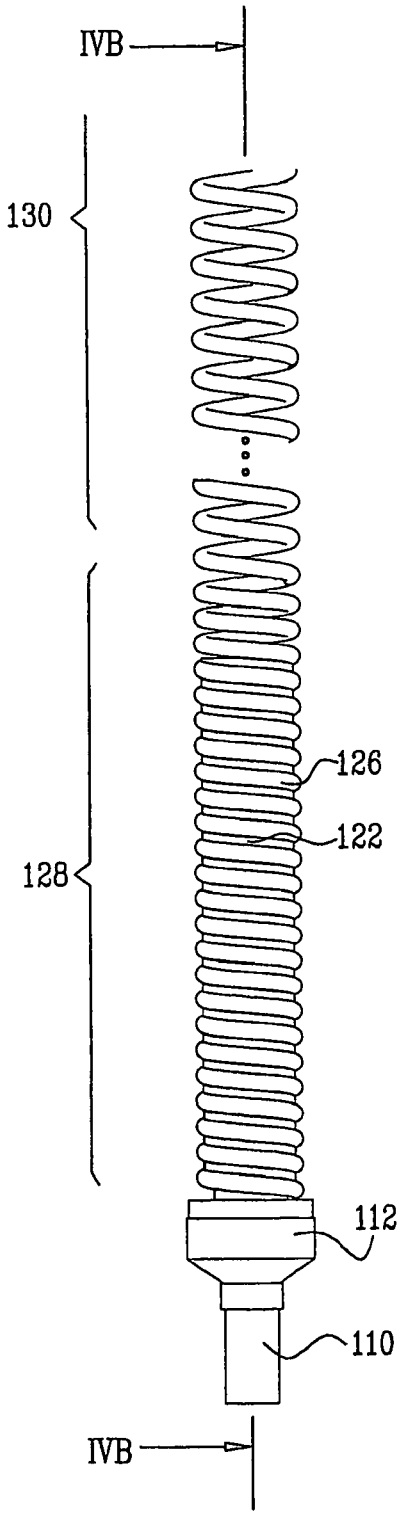
FIGS. 4A and 4B are a simplified assembled pictorial illustration and a sectional illustration of the engagement of an antenna coil with the coil base internal support and the coil base element, as well as the mutual engagement therewith of a pin socket element, a pin socket collar and a pin, all forming part of the antenna assembly of FIGS. 1-2C, the sectional illustration being taken along section lines IVB-IVB in FIG. 4A.
Figure 4B:
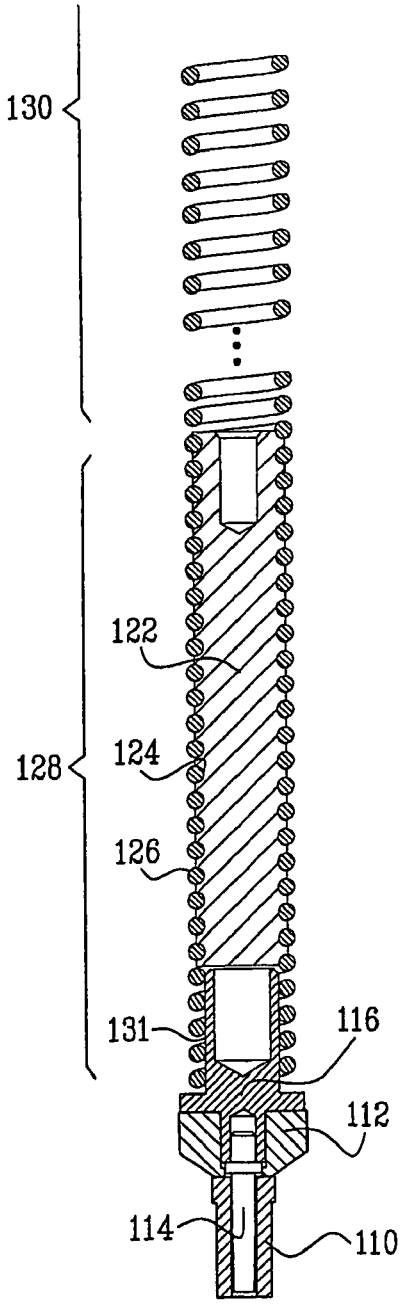

FIGS. 4A and 4B illustrate the engagement of antenna coil 126 with the coil base internal support 122 and the coil base element 116, as well as the mutual engagement therewith of pin socket element 110, pin socket collar 112 and pin 114, all forming part of the antenna assembly of FIGS. 1-2C. It is appreciated that a conductive path is defined by tight engagement between the interior of coil 126 at the bottom thereof with an exterior surface 131 of coil base element 116 and by mutual tight engagement between coil base element 116 and pin 114.

Figure 5A:
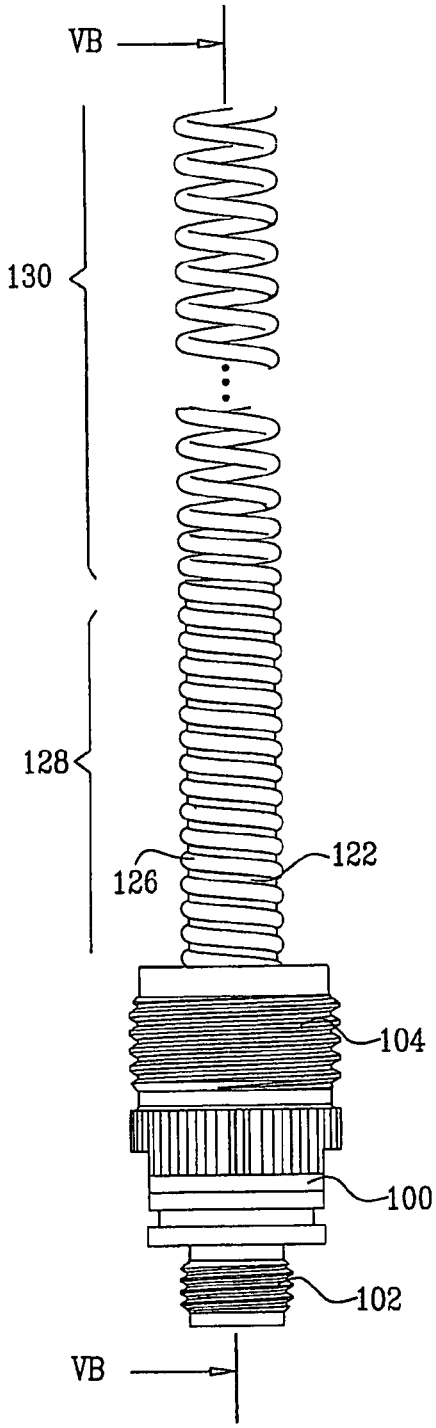
FIGS. 5A and 5B are a simplified assembled pictorial illustration and a sectional illustration of the engagement of an antenna coil with the coil base internal support and the coil base element, as well as the mutual engagement therewith of pin socket element, pin socket collar, pin and a base, all forming part of the antenna assembly of FIGS. 1-2C, the sectional illustration being taken along section lines VB-VB in FIG. 5A.
Figure 5B:
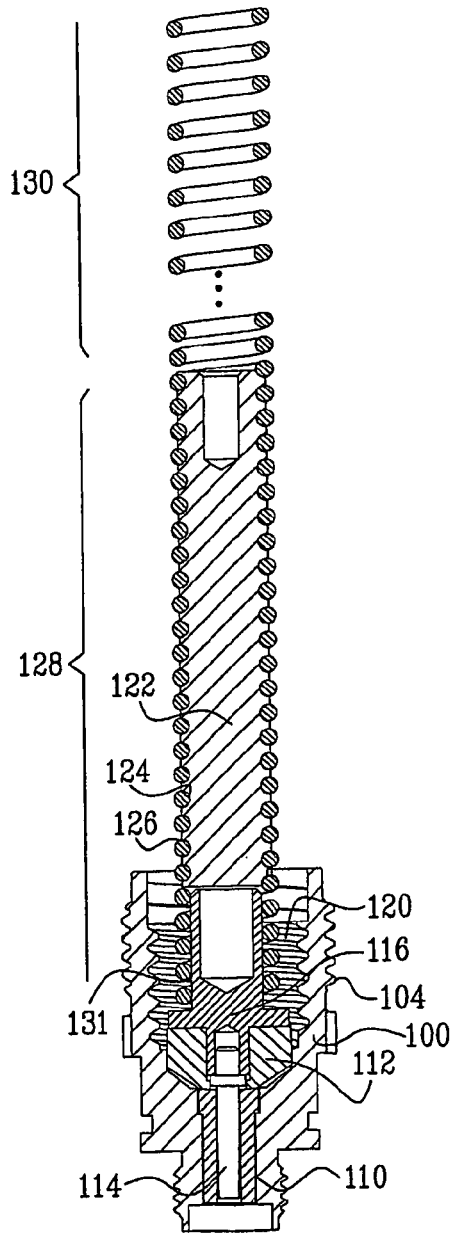

FIGS. 5A and 5B are similar to FIGS. 4A and 4B and additionally illustrate engagement of the pin socket element 110 and pin socket collar 112 with base 100. It is appreciated that a conductive path is defined by tight engagement between the interior of coil 126 at the bottom thereof with an exterior surface 131 of coil base element 116 and by mutual tight engagement between coil base element 116 and pin 114, which are insulated from base 100 by pin socket collar 112 and pin socket element 110.

Figure 6A:
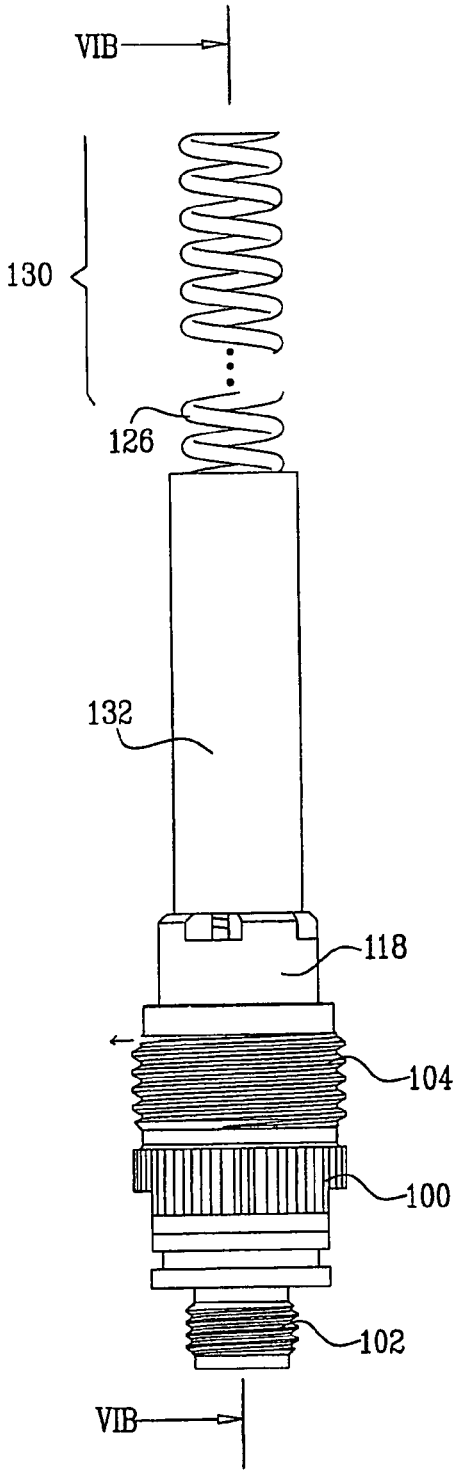
FIGS. 6A and 6B are a simplified assembled pictorial illustration and a sectional illustration of the engagement of the antenna coil with a dielectric separator and an antenna base element, as well as with the coil base internal support and the coil base element, and the mutual engagement therewith of pin socket element, pin socket collar, pin and base, all forming part of the antenna assembly of FIGS. 1-2C, the sectional illustration being taken along section lines VIB-VIB in FIG. 6A.
Figure 6B:
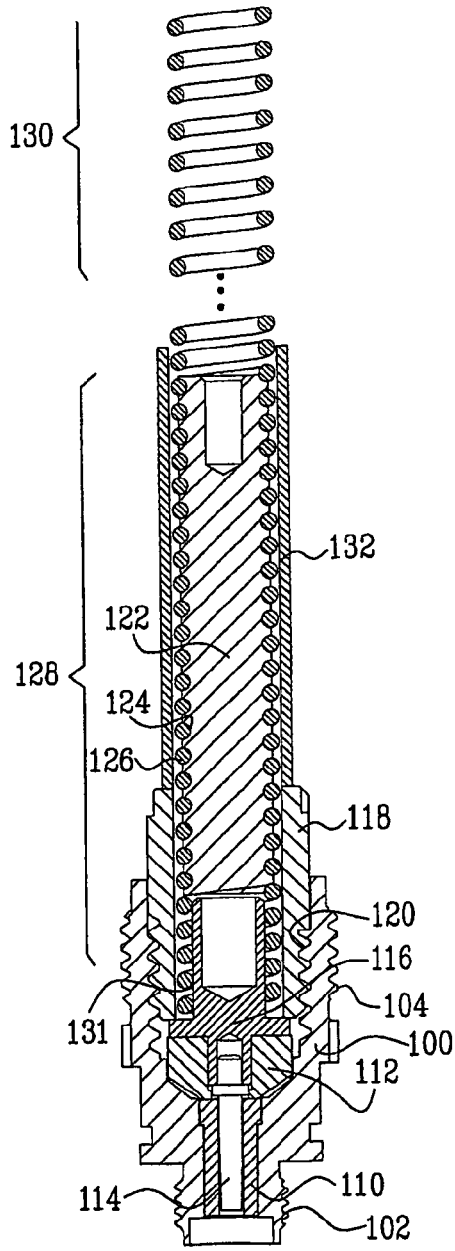

FIGS. 6A and 6B are similar to FIGS. 5A and SB, and additionally illustrate threadable engagement between internal threading 120 of base 100 and externally threaded locking element 118, thereby locking the coil base element 116 within base 100. A dielectric separator 132 is disposed in engagement with threaded locking element 118 overlying an outside surface of first longitudinal portion 128 of antenna coil 126 and separating first longitudinal portion 128 from a cylindrical radiating element, such as a conductive outer antenna base element 134, mounted on dielectric separator 132, which is shown with particular clarity in FIG. 2C. The conductive outer antenna base element 134 includes an interior threaded portion 136 which threadably engages external threading 104 of base 100, as shown with particular clarity in FIG. 2C.

As seen with particular clarity in FIG. 2A, a dielectric flexible antenna cover element 138 is located externally of the assembly that is described hereinabove with reference to FIGS. 5A and 5B, and has an associated tip 140.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. A monopole antenna comprising:

a helical radiating element including a first longitudinal portion having a first winding pitch and a second longitudinal portion having a second winding pitch;

a cylindrical radiating element located exterior of said helical radiating element, being generally coaxial with and enclosing said helical radiating element and extending along and about at least most of said first longitudinal portion;

a dielectric separator located between said helical radiating element and said cylindrical radiating element; and a dielectric insert located interior of said helical radiating element and being configured to maintain said first winding pitch of said first longitudinal portion of said helical radiating element;

whereby said helical radiating element and said cylindrical radiating element provide a coaxial conductive path between a base of said helical radiating element and a portion of said helical element extending beyond said cylindrical radiating element.

2. A monopole antenna according to claim 1 wherein said second winding pitch is greater than said first winding pitch.

3. A monopole antenna according to claim 2 and wherein said second winding pitch is 40-50% greater than said first winding pitch.

* * * * *